US006269963B1

(12) United States Patent
Hall

(10) Patent No.: US 6,269,963 B1
(45) Date of Patent: Aug. 7, 2001

(54) TRANSPORT CONTAINER

(75) Inventor: Daniel John Hall, Mossel Bay (ZA)

(73) Assignee: John Daniel Containers Limited, George (ZA)

( * ) Notice: Subject to any disclaimer, the term of this patent is extended or adjusted under 35 U.S.C. 154(b) by 0 days.

(21) Appl. No.: 09/230,589

(22) PCT Filed: Aug. 11, 1997

(86) PCT No.: PCT/US97/14242

§ 371 Date: Apr. 26, 1999

§ 102(e) Date: Apr. 26, 1999

(87) PCT Pub. No.: WO98/06630

PCT Pub. Date: Feb. 19, 1998

(30) Foreign Application Priority Data

Aug. 13, 1996 (ZA) ..... 96/6839

(51) Int. Cl.[7] ..... B65D 88/00
(52) U.S. Cl. ..... 220/1.5; 220/825
(58) Field of Search ..... 220/1.5, 810–816, 220/825; 105/243, 282.1; 298/24

(56) References Cited

U.S. PATENT DOCUMENTS 4,221,536 * 9/1980 McFee ..... 220/1.5
4,941,581 * 7/1990 Searles et al. ..... 220/1.5
4,995,522 2/1991 Barr ..... 220/1.5
5,076,457 * 12/1991 Marovskis ..... 220/1.5
5,147,061 9/1992 Karpisek ..... 220/334
5,170,901 * 12/1992 Bersani ..... 220/1.5
5,263,601 11/1993 Borow ..... 220/6
5,275,301 1/1994 Clive-Smith ..... 220/1.5

* cited by examiner

*Primary Examiner*—Joseph M. Moy
(74) *Attorney, Agent, or Firm*—Ladas & Parry

(57) ABSTRACT

A container (10) for use in the transportation of goods includes a floor (12) and a pair of opposed side walls (14, 16) each of which is supported for displacement about a pivotal axis adjacent its upper edge. The container (10) also includes hinge means (26) whereby one side wall (14) is disconnectably connectable adjacent its lower edge to the floor (12). The container (10) further includes first displacement means (52) for displacing the floor (12) laterally between a rest position in which goods can be contained within the container (10), and a displaced position. When the side wall (14) is connected to the floor (12). However, the floor (12) is displaced independently of the side wall (14) when the hinge means (26) is disconnected.

26 Claims, 16 Drawing Sheets

TRANSPORT CONTAINER

THIS INVENTION relates to the transportation of goods. More particularly it relates to a container and to a load carrying vehicle.

According to one aspect of the invention there is provided a container for use in the transportation of goods, which includes a floor;

a pair of opposed side walls, at least one of which is supported for displacement about a pivotal axis adjacent its upper edge;

hinge means whereby said one side wall is disconnectably connectable adjacent its lower edge to the floor; and first displacement means for displacing the floor laterally between a rest position in which goods can be contained within the container, and a displaced position.

According to another aspect of the invention there is provided a container for use in the transportation of goods, which includes a floor;

a pair of opposed side walls each of which is supported for displacement about a pivotal axis adjacent its upper edge;

hinge means whereby one side wall is connected adjacent its lower edge to the floor;

first displacement. means for displacing the floor and said one side wall between a rest position and a displaced position; and a pair of end walls, at least one of which is displaceable between an open and a closed position.

The hinge means may be configured so that said one side wall is disconnectably connectable to the floor.

The first displacement means may be configured such that when the floor and said one side wall are hingedly connected together, and the floor is displaced from its rest position towards its displaced position, the floor will tilt downwardly outwardly thereby facilitating the discharge of flowable goods from the container, e.g. particulate material such as wood chips, fly ash or the like, and when the floor and said one side wall are disconnected, the floor is then displaced laterally in a level fashion such that in its displaced position it protrudes from the container to facilitate the loading and unloading of goods, such as palletized goods and the like, e.g. by means of a forklift.

Hence, in use, when said one side wall is connected by the hinge means to the floor and the floor is displaced by the first displacement means, then said one side wall is displaced simultaneously with the floor, however, when said one side wall is disconnected from the floor, then displacement of the floor by the first displacement means is effected independently of said one side wall.

The first displacement means may include a drive member positioned underneath the floor and at least one elongate flexible element drivingly connecting the drive member to the floor.

The elongate flexible element may include at least one chain.

In one embodiment of the invention, the chain may extend around a drive sprocket and a driven sprocket spaced from the drive sprocket, the drive member being drivingly connected to the drive sprocket.

The first displacement means may include a connecting element connected to and extending between the chain and the floor.

In another embodiment of the invention, the first displacement means may include a pulley arrangement to which the drive member is drivingly connected for displacing the elongate flexible element, e.g. in the manner of a winch, and hence also the floor.

In one embodiment of the invention, the drive member may be operated by a pressurised fluid, e.g. it may be in the form of a pneumatic or hydraulic piston and cylinder assembly.

In another embodiment of the invention, the drive member may be electrically operated, e.g. it may be an electric motor.

In yet another embodiment of the invention, the drive member may be mechanically operated.

The container may include friction reducing floor support means for supporting the floor to facilitate displacement thereof between its rest and displaced positions. The friction reducing floor support means may include a plurality of longitudinally spaced apart transversely extending tracks and longitudinally spaced apart sets of rollers which run on the tracks. Typically, the rollers will be connected to the underside of the floor and the tracks will be fixed to a support. The support on which the tracks are supported may form an integral part of the container, e.g. it may be a base frame. Instead, the support may be part of a load carrying vehicle. Each roller may have an annular recess therein within which a portion of the associated track is receivable to locate the roller laterally relative to the track.

The container may include second displacement means for displacing the other side wall between a closed position and an open position. The second displacement means may include at least one elongate connecting member connected to and extending between the side wall such that the side walls are displaced simultaneously. Instead, or in addition, the second displacement means may be configured to displace the other side wall independently of the floor and said one side wall. Hence, the second displacement means may include a pressurised fluid operated piston and cylinder arrangement configured to displace the other side wall between its closed and open positions.

The container may include third displacement means for displacing said one side wall, when not connected to the floor, outwardly away from its rest position, i.e. in a direction opposite to the direction in which it is displaced by the first displacement means when it is connected by the hinge means to the floor, to an open position. The third displacement means may include a pressurised fluid operated piston and cylinder arrangement configured to displace said one side wall between its open and closed positions.

The container may include fourth displacement means for displacing said one end wall between its open and closed positions. In a preferred embodiment of the invention, said one end wall may be hingedly mounted for pivotal displacement about a pivot axis adjacent its lower edge between its open and closed position. The fourth displacement means may include a pressurised fluid operated piston and cylinder assembly.

The container may include locking means for retaining said one side wall releasably in its closed position.

According to still another aspect of the invention there is provided a container for use in the transportation of goods, which includes a body defining a goods receiving compartment;

an access opening through which access can be gained to the goods receiving compartment;

a closure member mounted for displacement between a closed position in which it closes off the access opening and an open position; and locking means for locking the closure member releasably in its closed position, the locking means including complementary locking components mounted on the body and on the closure member which complementary locking components cooperate when the door is in its closed position, and locking component displacement means configured to displace at least one of the locking components between an extended position in which the complementary locking components are releasably engageable and a retracted position such that displacement of said at least one of the locking components from its extended to its retracted position when the locking components are engaged serves to displace the closure member to its closed position.

The locking components may be engageable and disengageable only when said at least one of the locking components is in its extended position.

The locking component displacement means may include a rotatable eccentric element which cooperates with said at least one locking component.

The container may include a power source for operating the displacement means so that the container is self contained and does not require an external power source to permit operation of the displacement means.

The container may be dismountably mountable on a load carrying vehicle and include locking formations configured to cooperate with complementary locking formations on a said load carrying vehicle to retain the container releasably in position on said vehicle. The locking formations will typically be the conventional twist lock formations presently used on bulk transportation containers thereby permitting a container in accordance with the invention to be used together with existing bulk container handling equipment.

According to a further aspect of the invention, there is provided a load carrying vehicle which includes a chassis; and a container as described above mounted on the chassis.

The vehicle may be in the form of a motor vehicle or a trailer for a motor vehicle. Instead, the vehicle may be in the form of a railway wagon.

The invention will now be described, by way of example, with reference to the accompanying diagrammatic drawings.

Figure 1:
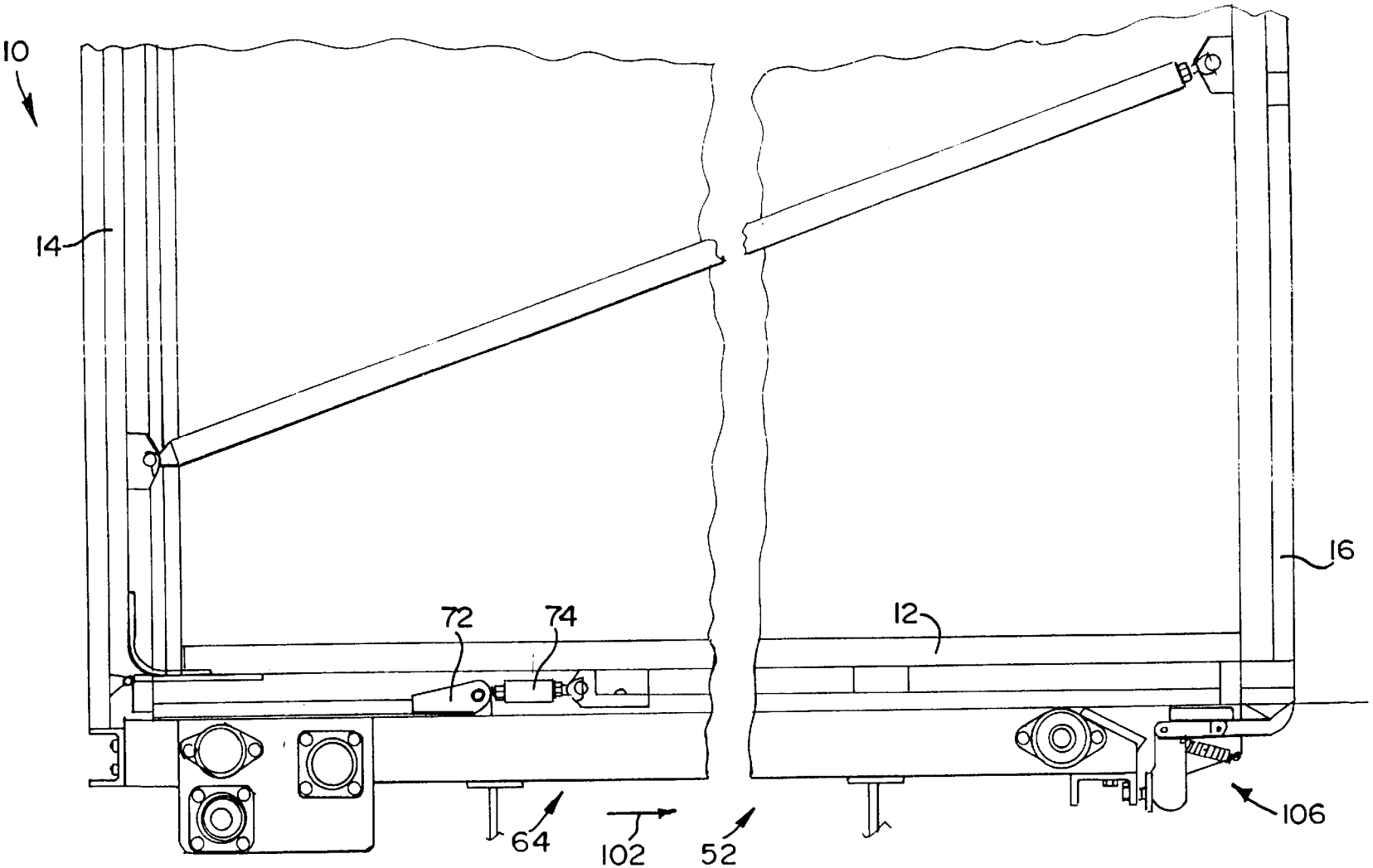
FIG. 1 shows an end view of part of a container for transporting goods in accordance with the invention, certain details being omitted.

In FIGS. 1 to 12 of the drawings, reference numeral 10 refers generally to a container for use in the transportation of goods in accordance with the invention.

Figure 17:
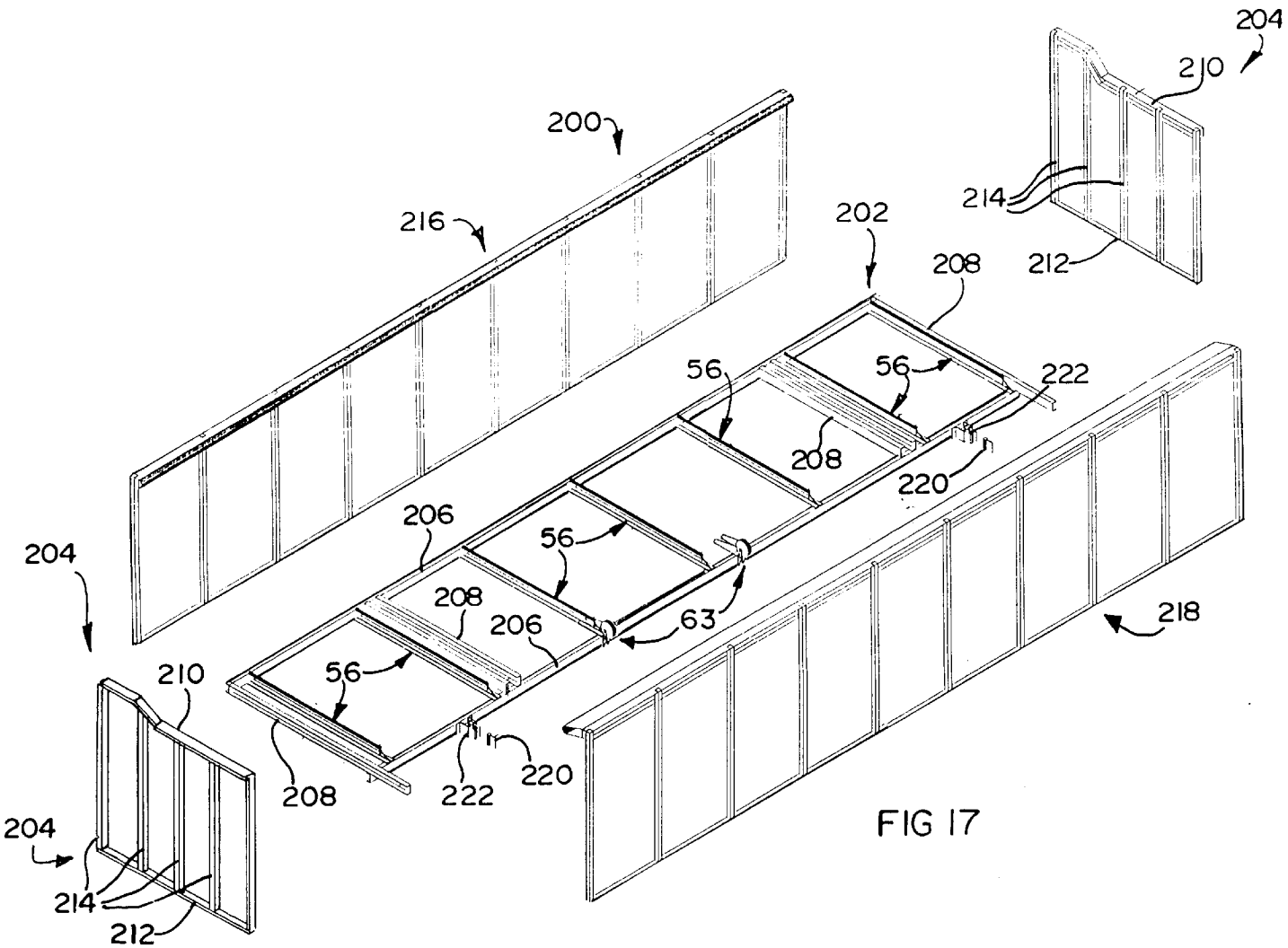
FIG. 17 shows a three-dimensional exploded view of a skeletal frame of the container of FIG. 1.

The container includes a support frame, generally indicated by reference numeral 200 in FIG. 17. The support frame 200 includes a generally rectangular base frame 202 and a pair of end frames 204 which are secured to opposed ends of the base frame 202, e.g. by welding, such that they extend vertically upwardly therefrom.

The base frame 202 includes a pair of parallel transversely spaced apart longitudinally extending frame members 206 and a plurality of longitudinally spaced apart parallel transversely extending bracing members 208 connected to and extending between the frame members 206.

Each of the end frames 204 includes a top frame member 210, a bottom frame member 212 and a plurality of vertically extending reinforcing members 214 connected to and extending between the top and bottom frame members 210, 212.

The frame includes mounting formations (not shown) whereby the container is dismountably mountable on a load carrying vehicle.

The container 10 includes a rectangular floor 12, a pair of side walls 14, 16 and a pair of end walls 18, 20.

With reference once again to FIG. 17 of the drawings, each of the side walls 14, 16 comprises a skeletal frame 216, 218, respectively, to which cladding, e.g. in the form of corrugated sheet metal is applied.

The side wall 14 is pivotally connected adjacent its upper edge via a pivot connection 22 (FIG. 12) to the support frame 200 so that the side wall 14 is pivotally displaceable about a pivot axis which extends adjacent with and parallel to its upper edge. Similarly, the side wall 16 is pivotally connected to the support frame 200 via a pivot connection 24 (FIG. 12) for pivotal displacement relative to the support frame about a pivot axis which extends adjacent with and parallel to the upper edge of the side wall 16.

In addition, the container 10 includes hinge means, generally indicated by reference numeral 26, whereby the side wall 14 is disconnectably connectable adjacent its lower edge to the floor 12.

Figure 2:
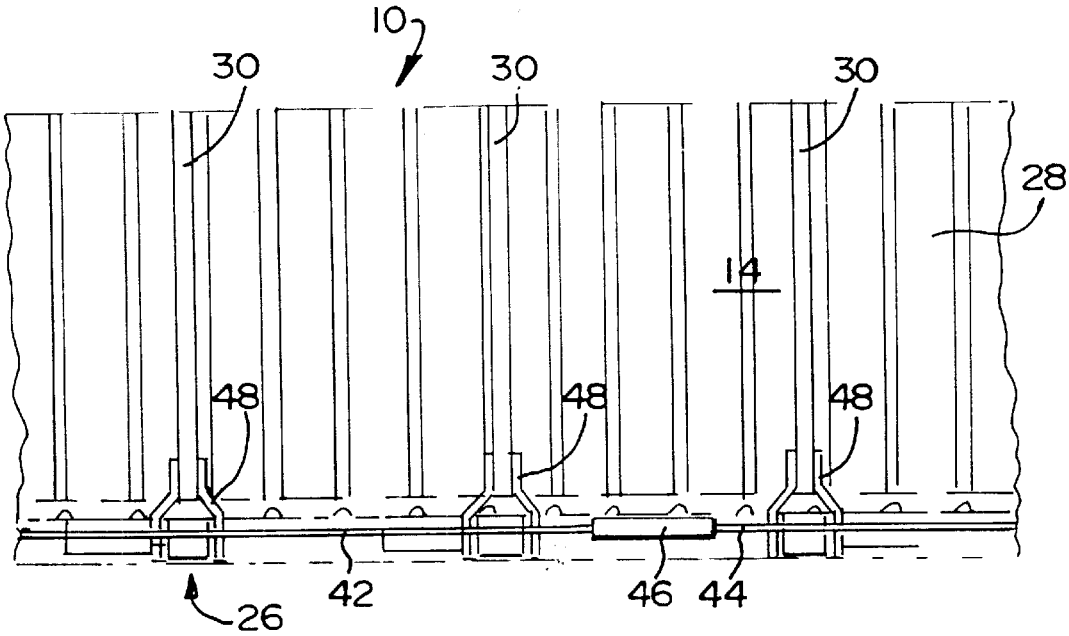
FIG. 2 shows a side view of part of the container.
Figure 3:
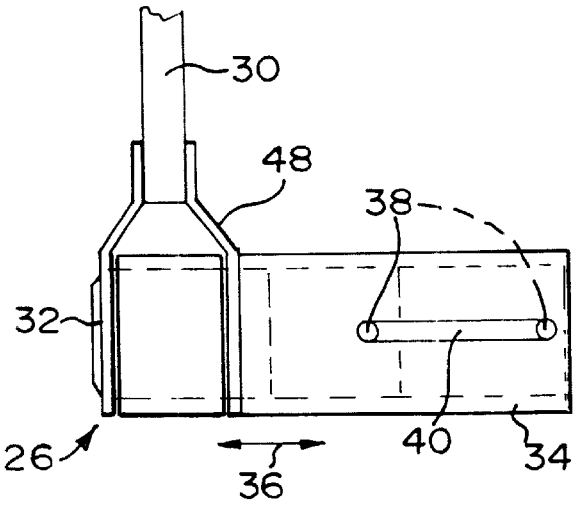
FIG. 3 shows, in more detail, part of a hinge arrangement forming part of the container of FIGS. 1 to 3.
Figure 4:
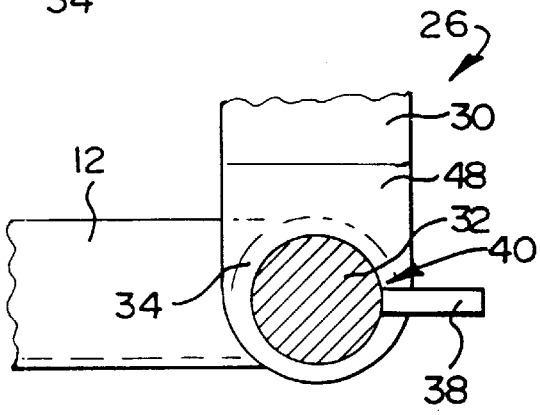
FIG. 4 shows a side view of the hinge arrangement of FIG. 4.
Figure 5:
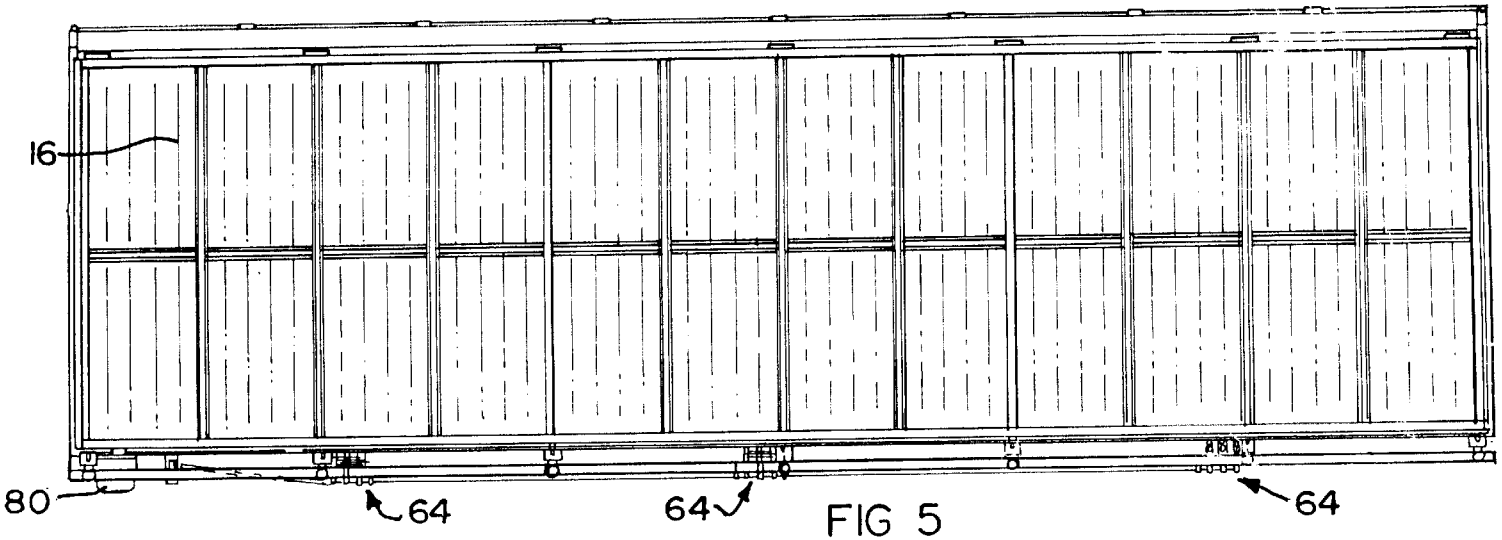
FIG. 5 shows a side view of the container with certain features omitted for the sake of clarity.
Figure 6:
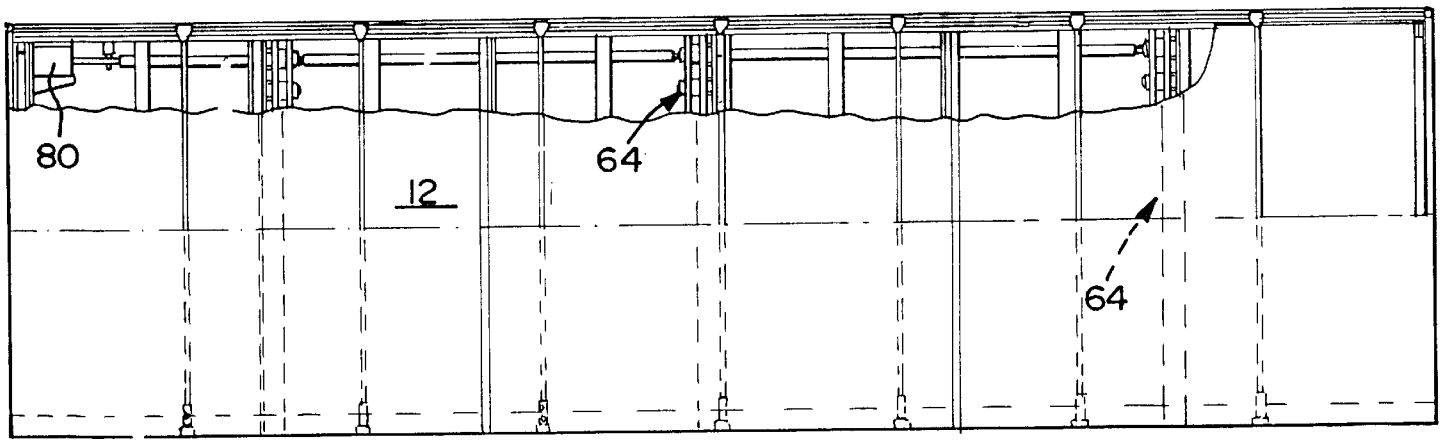
FIG. 6 shows a plan view of the container with part of the roof and part of the floor omitted.

As can best be seen in FIGS. 2, 3 and 4 of the drawings the side wall 14 includes a side wall panel 28 to which a plurality of longitudinally spaced apart parallel braces or supports 30 are attached. Each support 30 is typically in the form of a channel or box section which is welded to the panel 28 to improve the rigidity thereof.

The hinge means 26 includes a plurality of longitudinally spaced apart hinge pins 32 each of which is slidably mounted in a pin guide 34 for displacement, as indicated by arrow 36 (FIG. 3), between a locked position (shown in solid lines in FIG. 3 of the drawings) and a released position (shown in broken lines in FIG. 3 of the drawings). A connecting rod 38 is connected to each hinge pin 32 and protrudes therefrom through a longitudinally extending slot 40 in the pin guide 34. The connecting rods 38 of the hinge pins 32 positioned on one half of the container 10 are connected together by a connecting bar 42. Similarly, a connecting bar 44 connects together the connecting rods 38 of the hinge pins 32 positioned on the other half of the container 10. The innermost ends of the connecting bars 42, 44 are connected to a fluid actuated, typically hydraulic, double acting piston and cylinder arrangement 46.

The hinge means 26 further includes a plurality of saddle members 48 connected to the supports 30. Each saddle member 48 has a pair of limbs each of which has an aperture therethrough and which are positionable with the apertures in register with the hinge pins 32 so that, as illustrated in FIG. 3 of the drawings, with the hinge pins in their locked positions, the side wall 14 is hingedly connected to the floor 12 and with the hinge pins 32 in their released positions the side wall 14 and floor 12 are disconnected and capable of independent displacement.

It will be appreciated that displacement of the connecting bars 42, 44 will be in opposite directions as a result of extension or retraction of the piston and cylinder arrangement 46. Further, it is to be appreciated, that a single connecting bar could be used or alternatively a plurality of piston and cylinder arrangements could be used in order to displace the connecting bars.

Figure 26:
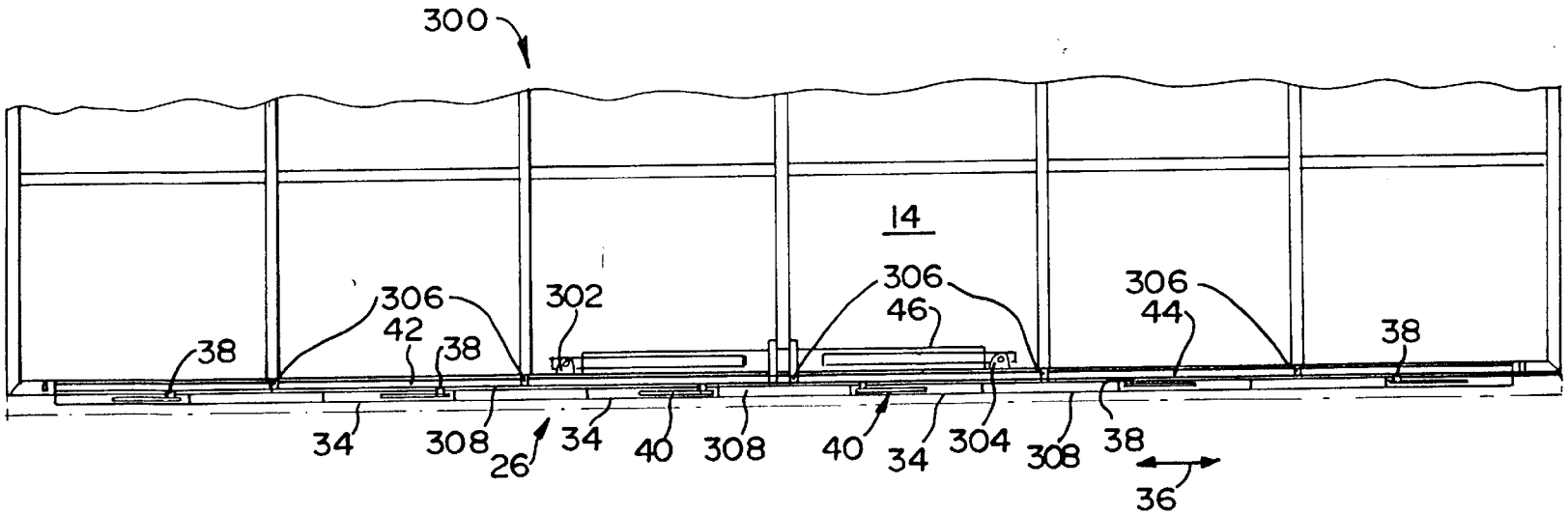
FIG. 26 shows a side view of part of another container in accordance with the invention illustrating the hinge arrangement.
Figure 27:
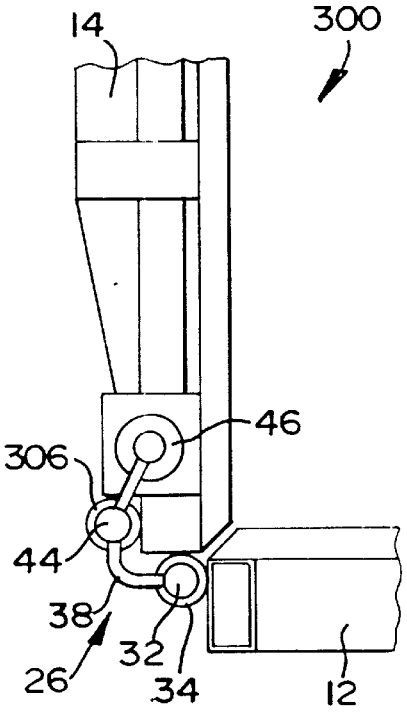
FIG. 27 shows an end view of the hinge arrangement of FIG. 26.
Figure 28:
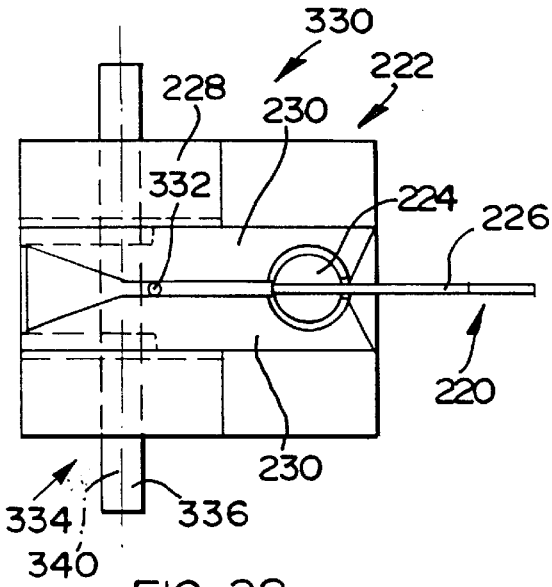
FIG. 28 shows a plan view similar to FIG. 21 of another locking arrangement in accordance with the invention in its locked condition.
Figure 29:
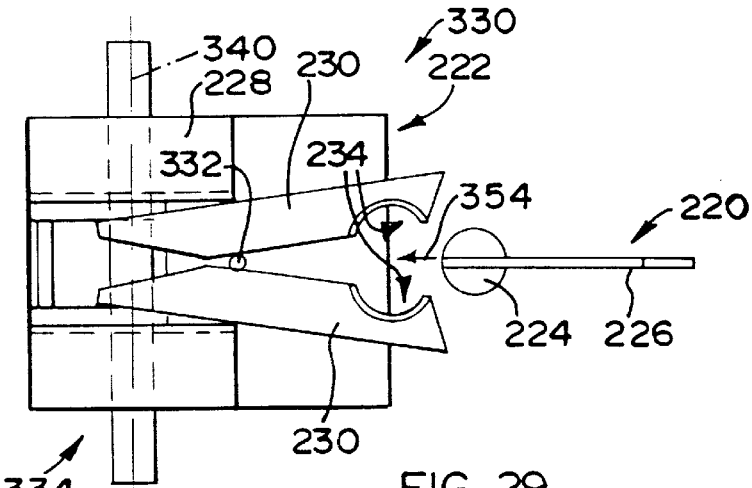
FIG. 29 shows a plan view similar to FIG. 28 with the locking arrangement in an unlocked configuration.
Figure 30:
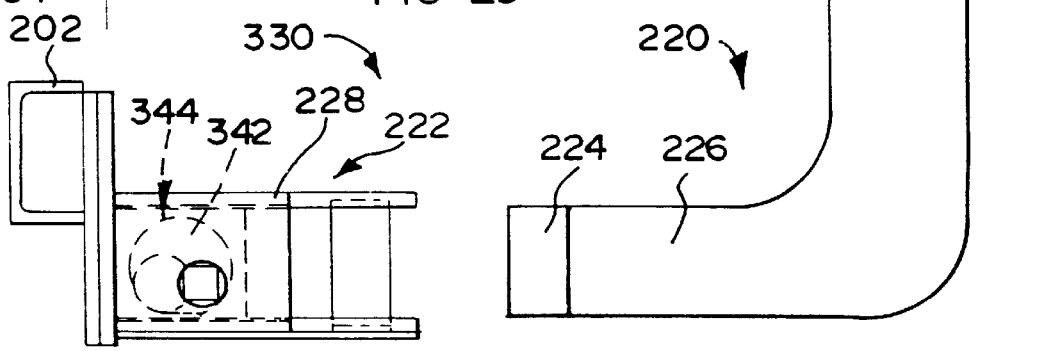
FIG. 30 shows a side view of the locking arrangement of FIGS. 28 and 29.

In this regard, reference is made to FIGS. 26 and 27 of the drawings, in which reference numeral 300 refers generally to part of another container in accordance with the invention and, unless otherwise indicated, the same reference numerals used above are used to designate similar parts.

One difference between the hinge means 26 of the container 300 and the hinge means 26 of the container 10 is that, in the case of the container 300, the piston and cylinder arrangement 46 is connected to the connecting bars 42, 44 by connecting lugs 302, 304, respectively. In addition, the connecting bars 42, 44 are supported in bushes 306.

Finally, instead of making use of the saddle members 48, in the case of the container 300, the pin guides 34 are spaced further apart and a plurality of tubular elements 308 is connected to the door 14 at longitudinally spaced apart positions, the tubular elements 308 being snugly receivable between the pin guides 34 when the door 14 is in its closed position. Operation of the hinge means 26 is substantially identical to that described above, with the hinge pins 32 being displaceable into and out of engagement with the tubular elements 308.

In addition, any other hinge arrangement which is selectively operable to enable the side wall 14 to be disconnectably connected to the floor 12 could be used.

Figure 7:
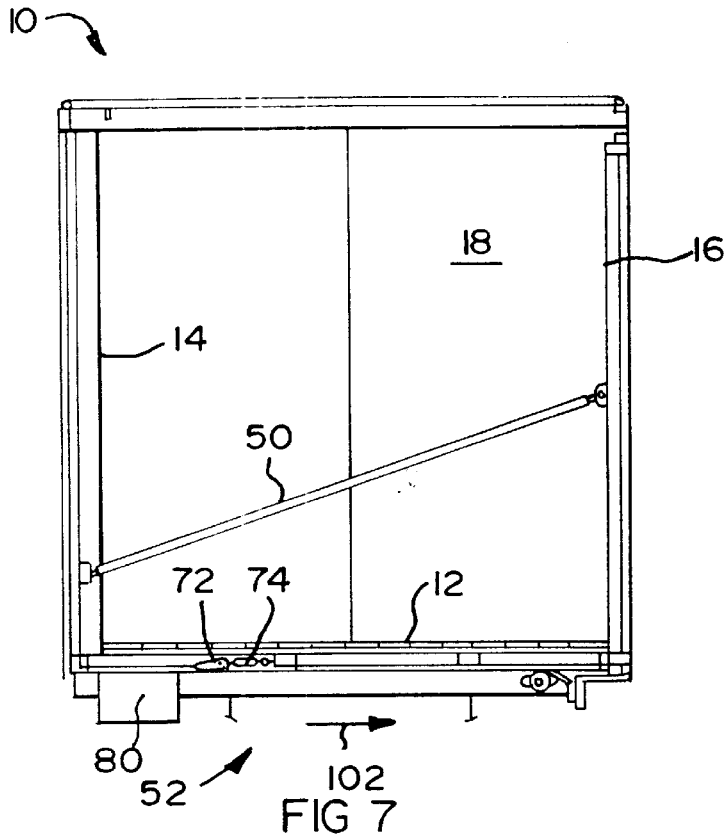
FIG. 7 shows an end view of the container of FIGS. 5 and 6 with an end wall omitted.
Figure 10:
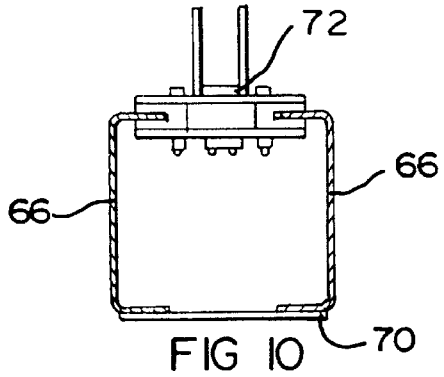
FIG. 10 shows a sectional elevation taken at X—X in FIG. 8.
Figure 11:
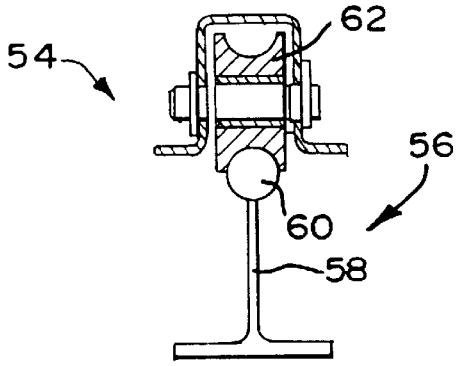
FIG. 11 shows on an enlarged scale, a sectional elevation of a roller-track arrangement forming part of the container.

The container 10 includes second displacement means for displacing the side wall 16. The second displacement means includes a pair of elongate struts 50 (one of which is shown in FIGS. 1 and 7) which are connected to and extend between the side walls 14, 16. Each strut is pivotally and disconnectably connected at its ends respectively to the side walls 14, 16.

The container 10 includes first displacement means, generally indicated by reference numeral 52 for displacing the floor 12 laterally between a rest position (shown in FIG. 1 of the drawings) and one of two displaced positions depending, as described in more detail below, on whether or not the floor 12 and side wall 14 are connected together by the hinge means 26.

The container 10 also includes friction reducing floor support means, generally indicated by reference numeral 54 for supporting the floor 12 to facilitate displacement thereof between its rest and displaced positions.

The floor support means 54 includes a plurality of longitudinally spaced apart transversely extending tracks 56 connected to the base frame 202. As can best be seen in FIG. 11 of the drawings, each track 56 includes an inverted T-section 58 to which a rod 60 is connected. The floor support means 54 further includes longitudinally spaced apart sets of rollers 62 which are connected to the underside of the floor 12 and which run on the tracks 56. Once again as can best be seen in FIG. 11 of the drawings, each roller 62 has an annular recess therein within which a portion of the associated track is receivable to locate the roller laterally relative to the track. In addition, the floor support means includes seven longitudinally spaced apart edge rollers 63 configured, as can best be seen in FIGS. 12 and 17, to support the floor 12 when connected to the side wall 14 and displaced from its rest to its displaced position. The number of edge rollers 63 will depend on the length of the container and will be positioned to provide support to the floor over its entire length.

Figure 23:
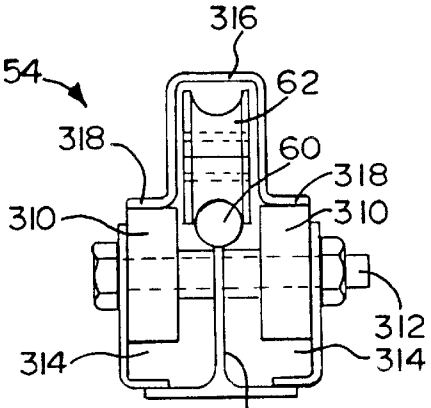
FIG. 23 shows a sectional elevation similar to FIG. 11, of the roller-track arrangement shown in FIG. 22.
Figure 22:
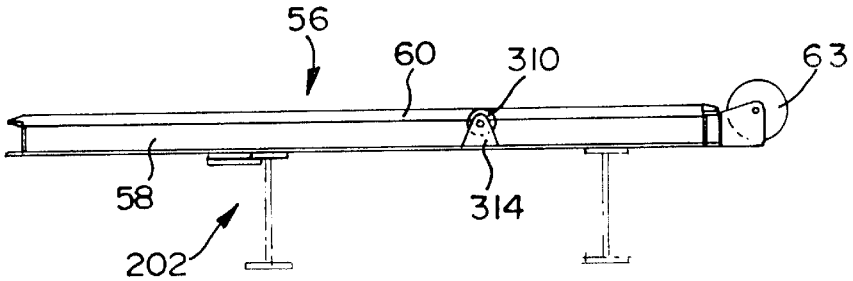
FIG. 22 shows a side view of part of a roller-track arrangement forming part of another container in accordance with the invention.

In another embodiment of the invention, as illustrated in FIGS. 22 and 23 of the drawings in which unless otherwise indicated the same reference numerals are used to designate the same parts, the floor support means 54 includes a pair of floor supporting wheels 310 which are associated with each track 56. The wheels 310 are mounted on an axle 312 which in turn is supported by a pair of brackets 314 which are mounted on the T-section 58. The rollers 62 are connected to the underside of the floor 12 by means of elongate top hat sections 316 having outwardly protruding flanges 318 which run on the floor supporting wheels 310. Hence, the floor supporting wheels 310 provide additional support to the floor 12 to ensure smooth operation and reduce the risk of jamming.

Figure 8:
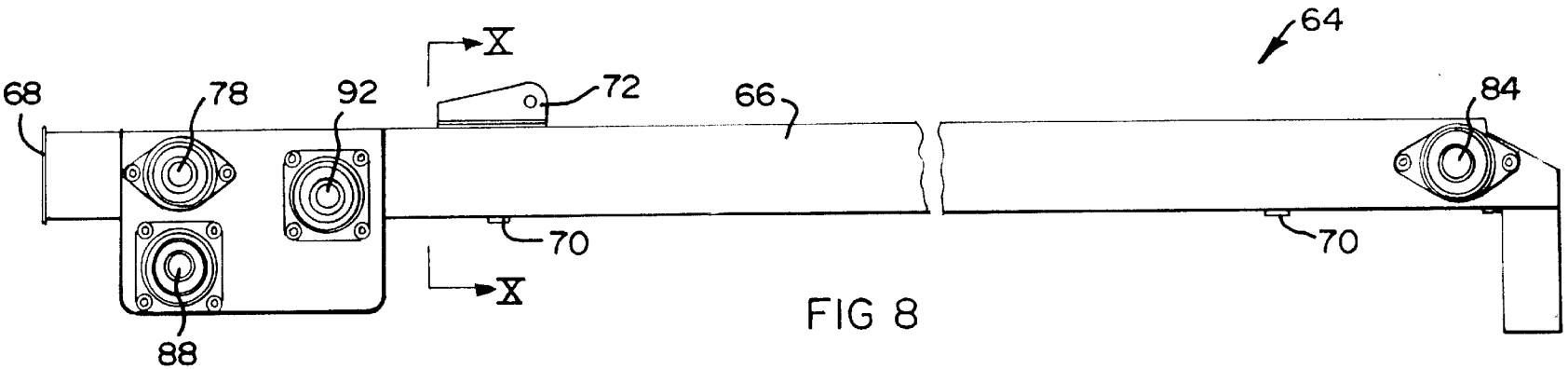
FIG. 8 shows, on an enlarged scale, part of the first displacement means for displacing the floor between its rest and displaced positions.
Figure 9:
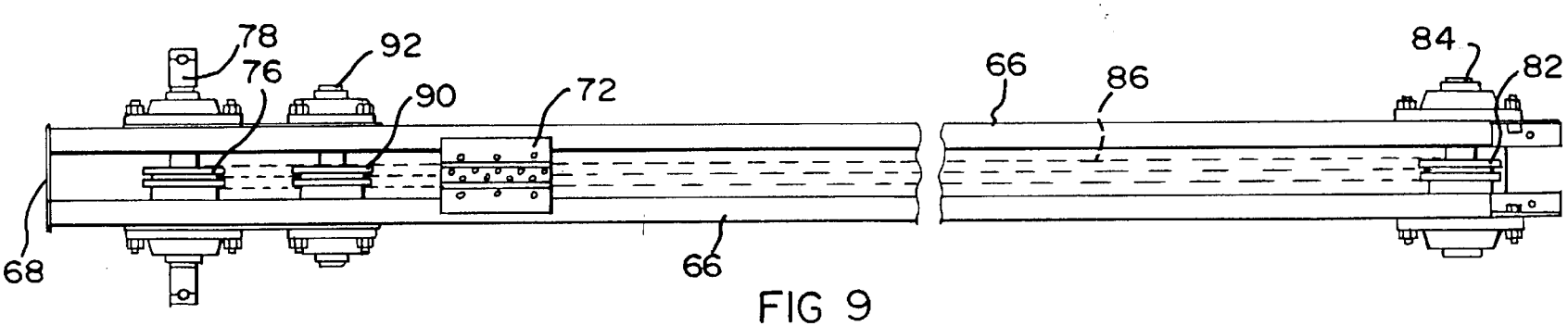
FIG. 9 shows a plan view of the part of the first displacement means shown in FIG. 8.

Referring now also to FIGS. 7 to 9 of the drawings, the first displacement means 52 includes a plurality of guides, generally indicated by reference numeral 64. Each guide 64 comprises a pair of parallel spaced apart inwardly facing channel members 66. An end cap 68 is connected, e.g. by welding, to the one end of the channels 66. A plurality of longitudinally spaced apart connecting members 70 is connected, e.g. by welding, to the operatively lower sides of the channel members 66 to retain them in the desired positions. A slide 72 is slidably mounted on and between the uppermost flanges of the channel members 66 such that it protrudes upwardly therefrom. A push rod 74 is pivotally connected at its ends to and extends between the slide 72 and the floor 12.

A drive sprocket 76 is mounted on a shaft 78 between the channel members 66. An electric motor 80 is drivingly connected to the shaft 78. An idler sprocket 82 is mounted on a shaft 84 such that it too is between the channel members 66. An endless chain 86 extends around the drive sprocket 76 and the idler sprocket 82 with the uppermost chain run being positioned between the channel members 66 and the lower chain run being positioned below the channel members 66. A guide sprocket (not shown) is mounted on a shaft 88 immediately below the drive sprocket 76 so as to guide the chain 86. An adjusting sprocket 90 is mounted on a shaft 92 and is positioned between the channel members 66 to engage the chain 86 and permit the tension thereof to be adjusted. The slide 72 and push rod 74 together drivingly connect the chain 86 to the floor 12.

The second displacement means, generally indicated by reference numeral 94 (FIG. 12) includes a pressurised fluid, typically hydraulic, piston and cylinder assembly 95 which is connected to the base frame and the side wall 16.

Figure 14:
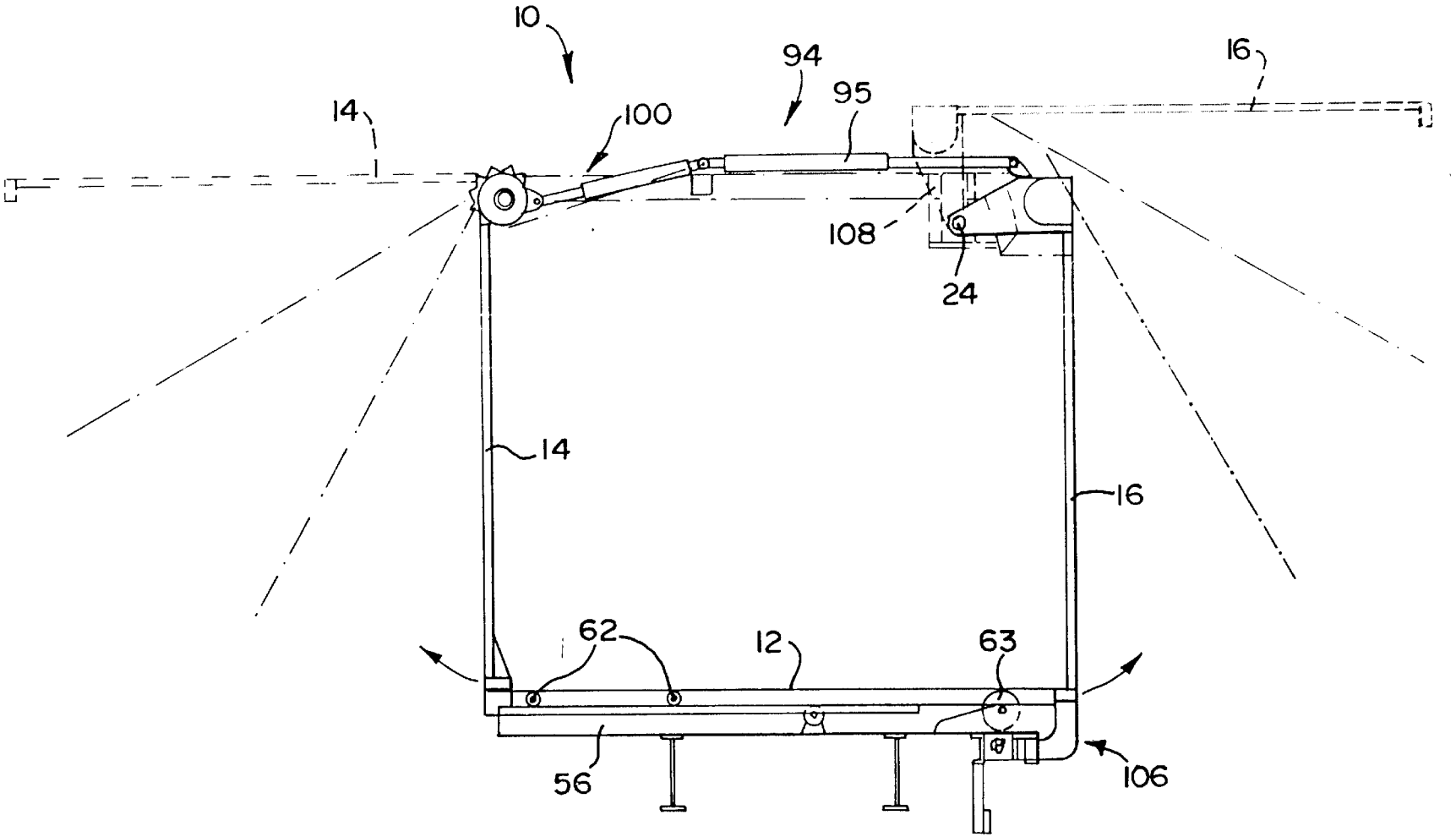
FIG. 14 shows an end view similar to FIGS. 12 and 13 with the side walls being displaced towards their open positions and the floor remaining in its rest position.

If desired, as illustrated in FIG. 14, the container 10 includes third displacement means, generally indicated by reference numeral 100, e.g. in the form of a pressurised fluid operated piston and cylinder assembly connected to the base frame and the side wall 14 in order to displace the side wall 14 between its open and closed positions as discussed in more detail herebelow.

In use, when it is desired to transport particulate material such as wood chips, fly ash and the like in the container 10, the struts 50 are connected to the side walls 14, 16 and the piston and cylinder arrangements 94, 100 are disengaged or rendered inoperative.

Figure 12:
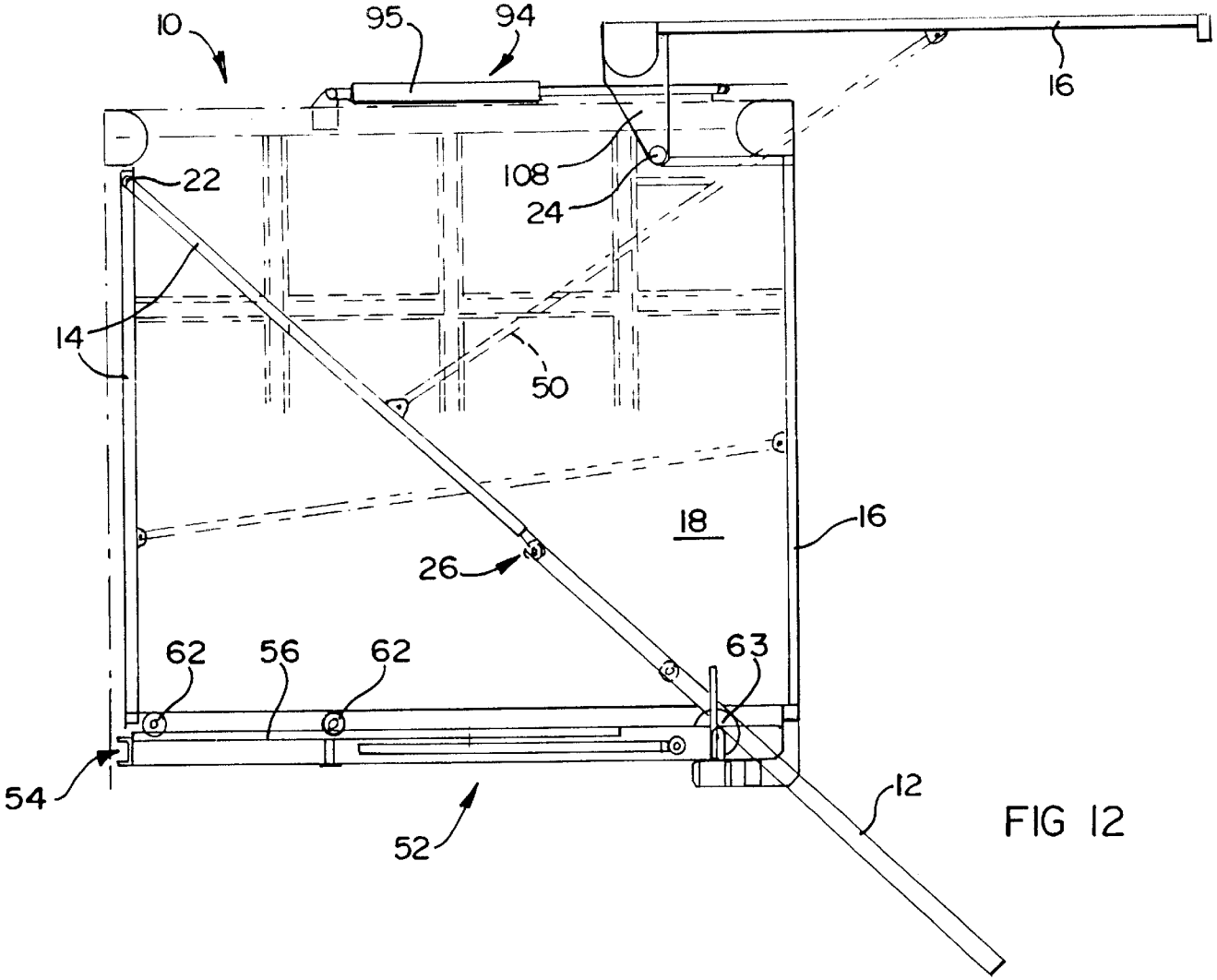
FIG. 12 shows an end view of the container with the floor and one side wall connected together and in a displaced position.

When it is desired to discharge goods contained within the container, the electric motor 80 is energised to drive the sprockets 76 and hence displace the upper runs of the chains and the slides 72 in the direction of arrow 102 thereby displacing the floor 12 and the side walls 14, 16 to their displaced positions (shown in FIG. 12 of the drawings). As can best be seen in FIG. 12 of the drawings, in the displaced positions of the side wall 14 and floor 12 they form a generally planar inclined support surface which facilitates the discharge of particulate material from the container.

When it is desired to return the floor 12 and side walls 14, 16 to their rest positions, the electric motor 80 is driven in the reverse direction which causes the slides 72 to be displaced in a direction opposite to the direction of arrow 102 thereby returning the various components of the container to their rest positions.

If, however, the container 10 is intended to carry other goods, e.g. palletised goods, then when it is desired to load the goods onto or off of the container 10, the hinge pins 32 are displaced to their released positions, the struts 50 are disconnected from at least one of the side walls 14, 16 and preferably from both of the side walls 14, 16 and the piston and cylinder arrangements 94, 100 (if applicable) are connected to the side walls 16, 14, respectively.

Hence, when it is desired to load goods on to the floor 12 of the container 10, one of the side walls 14, 16 can be displaced to an open position by activating the required piston and cylinder assembly, as illustrated in FIG. 14 of the drawings. Further, if desired, a vehicle on which the container 10 is mounted can be positioned adjacent to a loading platform 104 and the side wall 16 can be displaced to its open position (shown in FIG. 13 of the drawings). The first displacement means 52 can then be activated to displace the floor laterally, in the manner described above, so that the floor protrudes laterally from the container and the rollers 62 connected to the protruding portion of the floor 12 run on the surface of the support platform 104. In this position goods can readily be loaded on to or off the floor 12, e.g. by means of a forklift truck. Once the floor 12 is fully laden, the first displacement means 52 can be activated to return the floor 12 to its rest position and the side wall 16 can then be closed. The floor can be locked in its rest position by displacing the hinge pins 32 to their locked position and the side wall 16 can be locked in its closed position by means of a locking mechanism 106. It is to be appreciated that the container 10 can be loaded or unloaded from either side in the manner described above by displacing the appropriate side wall 14, 16 to its open position.

Figure 32:
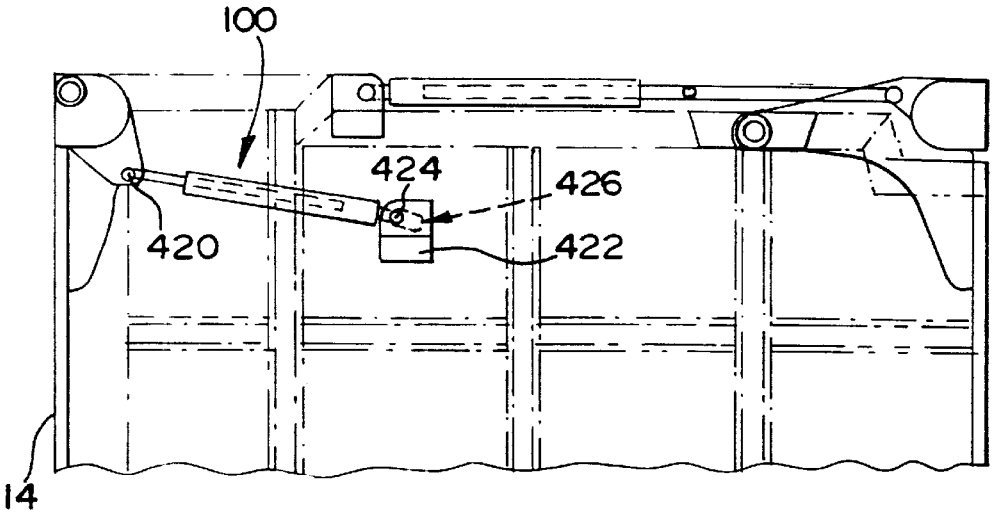
FIG. 32 shows a side view of third displacement means of another container in accordance with the invention.

Reference is now made to FIG. 32 of the drawings, in which an alternate arrangement for connecting the piston and cylinder arrangement 100 is shown. In this embodiment of the invention, one end of the piston and cylinder arrangement 100 is pivotally connected to the door 14 by a pivot pin 420. The other end of the piston and cylinder arrangement 100 is connected to a bracket 422 by a pivot pin 424. The pivot pin 424 extends through an elongated aperture 426 in the bracket 422 such that it is slidable in the aperture 426. The provision of the elongate aperture 426 has the advantage that the piston and cylinder arrangement 100 need not be disconnected when it is desired to displace the side wall 14 together with the floor since the provision of the elongate aperture 426 permits the piston and cylinder arrangement 100 to be displaced together with the side wall 14 when it is displaced together with the floor 12. If, however, it is desired to displace the side wall 14 to its open position, the hinge means can be disconnected and the piston and cylinder arrangement 100 extended. Initial extension of the piston and cylinder arrangement 100 causes the pivot pin 424 to be displaced in the aperture 426 to the position furthest from the side wall 14. Further extension of the piston and cylinder arrangement 100 causes the side wall 14 to be displaced towards its open position (shown in broken lines in FIG. 14 of the drawings).

When it is desired to return the side wall 14 to its closed position, the piston and cylinder arrangement 100 is retracted to its fully retracted position in which the pivot pin 424 is positioned at that end of the aperture 426 closest to the side wall 14.

The Inventor believes that the provision of the aperture 426 render the container more convenient to use since the piston and cylinder arrangement 100 need not be disconnected.

Figure 20:
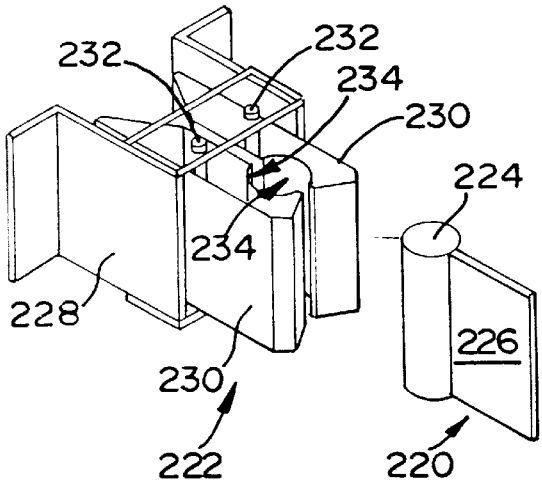
FIG. 20 shows a three-dimensional view of part of a locking arrangement in accordance with the invention.
Figure 21:
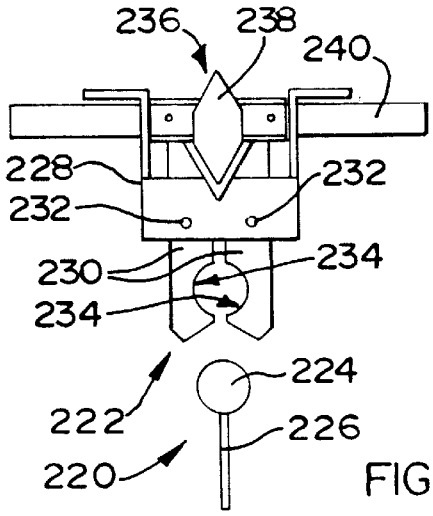
FIG. 21 shows a plan view of the locking arrangement of FIG. 20.

With reference specifically to FIGS. 17, 20 and 21 of the drawings, the locking mechanism includes a plurality of longitudinally spaced apart locking elements or components 220 mounted on the side wall 16, and complementary locking devices or components 222 mounted on the base frame 202.

Each locking element 220 comprises a circular cylindrical rod 224 which is arranged with its axis extending vertically and which is connected to the side wall 16 by a connecting plate 226.

Each locking device 222 comprises a housing 228 mounted on the base frame 202 and a pair of gripping members 230 pivotally mounted via pivot pins 232 to the housing 228. The gripping members 230 have outer ends which, as can best be seen in FIG. 21 of the drawings, are chamfered so as to facilitate the insertion of at least the rod 224 of the associated locking element 220 into the locking device 222. Opposed concave recesses 234 are provided in the gripping members 230 immediately adjacent their outer ends, the recesses 234 being complementary in shape to the rod 224.

The inner ends of the gripping members 230 are tapered such that their inner surfaces diverge away from the leading or outer ends of the gripping members 230.

The locking mechanism 106 further includes a locking member 236 associated with each of the locking devices 222. The locking member 236 is in the form of a circular wedge 238 which is mounted eccentrically on a shaft 240. The shaft 240 is displaceable by means of an electric motor (not shown) between a locked condition (shown in FIG. 21 of the drawings) in which the wedge 238 is positioned between the trailing ends of the gripping members 230 and a released position (not shown) in which the wedge 238 is clear of the gripping members 230.

Hence, in use, when the side wall 16 is being displaced towards its closed position, the shaft 240 is in its released position and when the rods 224 abut the leading ends of the associated gripping members 230 the gripping members 230 are displaced outwardly until the rod 224 is positioned in register with the recesses 234. In this position the shaft 240 is rotated so as to displace the wedge 238 to its closed position (shown in FIG. 21) in which it cooperates with the inner surfaces of the gripping members 230 to displace the gripping members 230 into their locked positions (shown in FIG. 21 of the drawings) in which the rod 224 is held captive therebetween. If desired operation of the locking mechanism may be electronically controlled, e.g. requiring the entry of a code or password via a keypad to unlock the locking mechanism.

Reference is now made to FIGS. 28 to 31 of the drawings, in which reference numeral 330 refers generally to another embodiment of a locking mechanism of a container in accordance with the invention and, unless otherwise indicated, the same reference numerals used above are used to designate similar parts. The locking mechanism 330 is similar to the locking mechanism 106 however, there are several differences which are discussed in more detail herebelow. In the case of the locking mechanism 330, the locking components or gripping members 230 are slidably displaceable in the housing 228 between a retracted or locked position shown in FIG. 28 of the drawings, and an extended or unlocked position (shown in FIG. 29 of the drawings). A spacer element or pin 332 is secured, e.g. by welding, to one of the gripping members 230, the spacer pin 332 being positioned between the gripping members 230 so as to space them apart. The locking mechanism 330 further includes locking component displacement means, generally indicated by reference numeral 334 whereby the gripping members 230 are displaceable between their extended and retracted positions. The locking component displacement means 334 includes a shaft 336 which is rotatably mounted on a bracket 338 which in turn is mounted on the base frame 202. The shaft 336 is rotatable about an axis of rotation 340. An eccentric element 342 is mounted on the shaft and is positioned in complementary apertures 334 in the gripping members 230 such that rotation of the shaft 336 about the axis of rotation 340 causes rotation of the eccentric element 342 which in turn results in displacement of the gripping members 230 between their extended and retracted positions.

Figure 31:
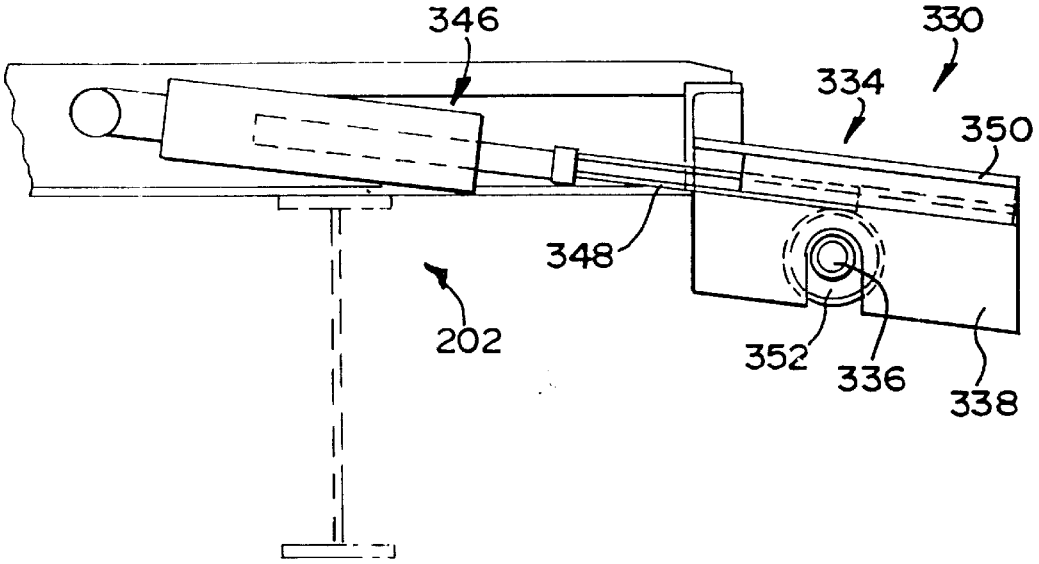
FIG. 31 shows an actuator for the locking arrangement of FIGS. 28 to 30.

As can best be seen in FIG. 31 of the drawings, the locking component displacement means 334 further includes a hydraulic piston and cylinder assembly 346 one end of which is connected to the base frame 202. A toothed rack 348 is connected at its one end to the end of the piston of the piston and cylinder assembly 346 and is slidably supported in a slide 350 mounted on the bracket 338. A pinion 352 is mounted on the shaft 336 and the rack 348 drivingly engages the pinion 352 such that rotation of the shaft 336 is effected by extension or retraction of the piston and cylinder assembly 346.

In use, with the gripping members 230 in their extended position (shown in FIG. 29 of the drawings), the side wall 16 is displaced towards its closed position, i.e. in the direction of arrow 354. When the rods 224 abut the leading ends of the associated gripping members 230, i.e. when the rods 224 are positioned between the recesses 234, the piston and cylinder assembly 346 is caused to retract. This in turn displaces the rack 348 which cooperates with the pinion 352 to rotate the shaft 336. Rotation of the shaft 336 and hence of the eccentric element 342 causes the gripping members 230 to be retracted into the housing 228. Initially, the retraction of the gripping members 230 causes them to close and grip the rod 224. Subsequently, the gripping members 230 are drawn into their retracted position (shown in FIG. 28 of the drawings) which in turn draws the door 16 inwardly to its closed position.

It is to be appreciated, that the rod 224 and gripping members 234 are engageable and disengageable only when the gripping members are in their extended positions so that when in their retracted position (shown in FIG. 28 of the drawings) the door is held securely in its closed position.

This arrangement has the advantage that, if in use the door 16 becomes bowed or buckled the rod 224 and gripping members 234 engage before the door is in its fully closed position. This increases the chance that all of the rods 224 and their associated gripping members 234 will engage. The shaft is then rotated to displace the gripping members 230 to their retracted positions and finally draw the door 16 into its fully closed position in which it is held securely thereby compensating for slight deformations of the door.

As can be seen in FIG. 12 of the drawings, the side wall 16 is connected to the pivot connection 24 by a connecting piece 108 which protrudes orthogonally to the side wall 106 and serves to ensure that when the side wall 106 is displaced to its open position it is positioned above the upper edge of the base frame thereby improving access to the interior of the container 10.

It is to be appreciated, that the first displacement means could instead be operated by a winch arrangement or by means of a pressurised fluid operated piston and cylinder arrangement so as to permit the displacement of the floor either by tilting when connected to the side wall 14 or horizontally when disconnected from the side wall 14.

Figure 15:
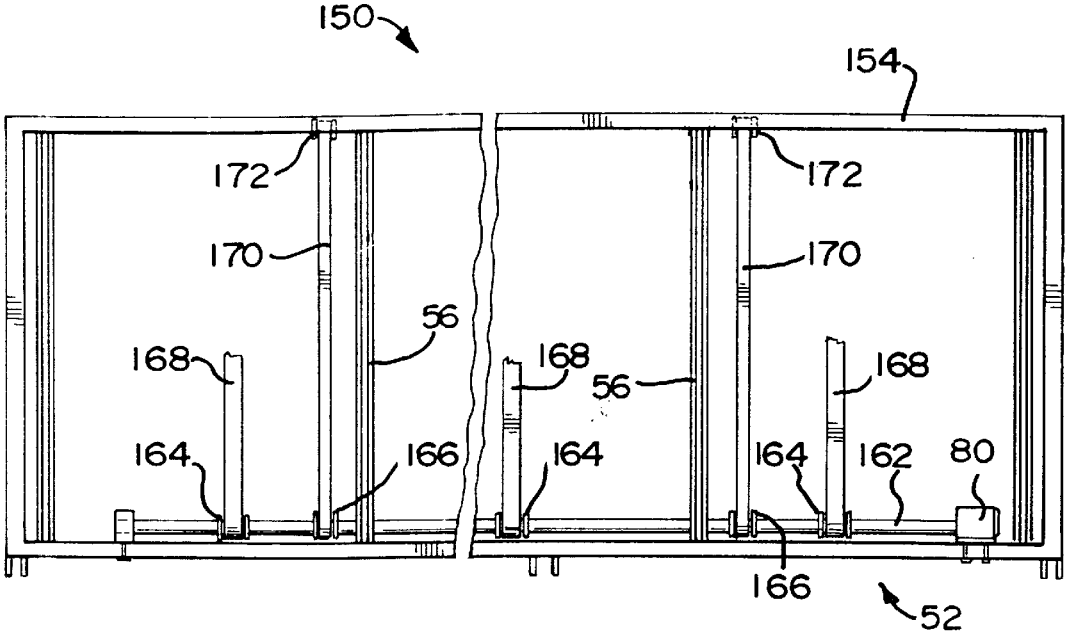
FIG. 15 shows a plan view similar to FIG. 6 of another container with the floor and walls omitted.

In this regard, reference is now made to FIG. 15 of the drawings, in which reference numeral 150 refers generally to part of another container in accordance with the invention and, unless otherwise indicated, the same reference numerals used above are used to designate similar parts. In this embodiment of the invention, the base frame includes a rectangular bottom frame 154. The first displacement means 52 includes a drive member in the form of an electric motor 80 mounted on the frame 154 and drivingly connected to a shaft 162. Three primary pulleys 164 and two secondary pulleys 166 are mounted on the shaft 164 at longitudinally spaced apart positions. An elongate flexible element 168, e.g. in the form of a length of webbing, is wound around each of the primary pulleys 164 with the free end of the flexible element 168 being connected to the floor (not shown) of the container 150 at a position adjacent the pivotal connection of the floor 12 to the side wall 14.

An elongate flexible element 170, e.g. in the form of a length of webbing, is wound around each of the secondary pulleys 166 with the flexible element 170 protruding from the secondary pulley 166 across the frame 154, around a return pulley 172, mounted on the opposite side of the frame 154 to the secondary pulley 166, with its free end being connected to the floor 12 at a position spaced from its pivotal connection to the side wall 14.

In use, the container 150 is mounted on a load carrying vehicle, e.g. on the load bed of a truck. The container 150 may have dimensions which correspond to the standard dimensions of bulk transportation containers and have complementary mounting and/or locking formations (not shown) whereby the container 150 is releasably lockable on the load bed of a container carrying vehicle.

A load contained within the container 1 50 is discharged therefrom in the identical fashion to that described above with reference to FIGS. 1 to 14 of the drawings. Hence, by energising the electric motor 80 and rotating the shaft 162 in one direction, the flexible elements 168 can be wound on to the primary pulleys 164 thereby displacing the floor 12 laterally. Depending on whether or not the floor 12 is connected to the side wall 14 it will be displaced laterally in a horizontal direction or alternatively it will be inclined. Rotating the shaft 162 in this direction causes the flexible elements 170 to unwind from the secondary pulleys 166. When it is desired to return the components of the container 150 to their closed or load carrying condition, the electric motor 80 is energised and the shaft 162 is rotated in the opposite direction so that the flexible elements 170 are wound on to the secondary pulleys 166 and the flexible elements 168 are unwound from the primary pulleys 164.

Figure 16:
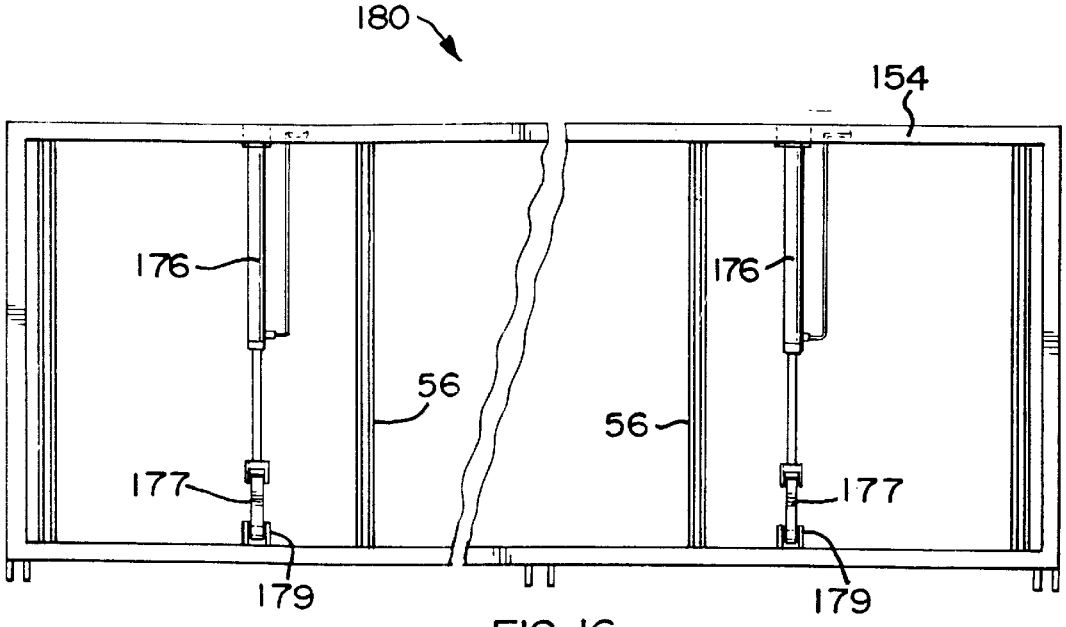
FIG. 16 shows a plan view similar to FIG. 15 of another container in accordance with the invention.

Reference is now made to FIG. 16 of the drawings, in which reference numeral 180 refers generally to part of still another container in accordance with the invention and, unless otherwise indicated, the same reference numerals used above are used to designate similar parts. In this embodiment of the invention, instead of making use of the electric motor 80, use is made of one or more pressurised fluid operated piston and cylinder assemblies 176, each of which is drivingly connected to the floor 12 via a flexible element, e.g. a length of webbing 177 extending around a pulley 179 to displace the floor 12 between its rest and displaced position in substantially the identical fashion to the described above.

The container 180 will typically include a reservoir of hydraulic fluid and a pump for pumping fluid from the reservoir to the piston and cylinder assemblies. The pump may be driven by an electric motor, an internal combustion engine or the like.

Figure 24:
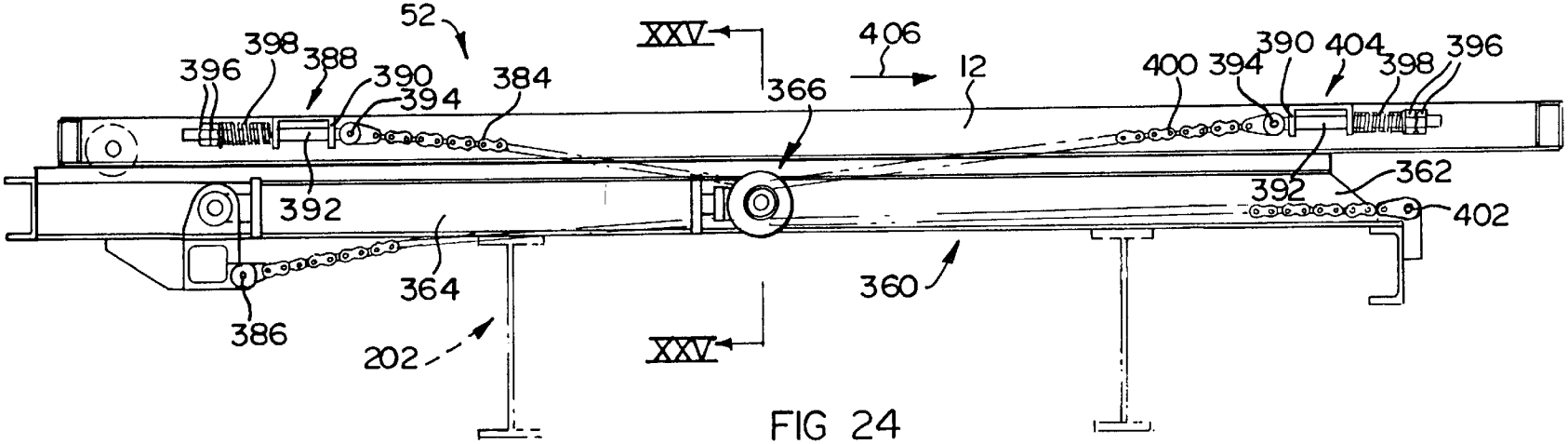
FIG. 24 shows a side view of part of the first displacement means of another container in accordance with the invention for displacing the floor of said other container between its rest and displaced position.
Figure 25:
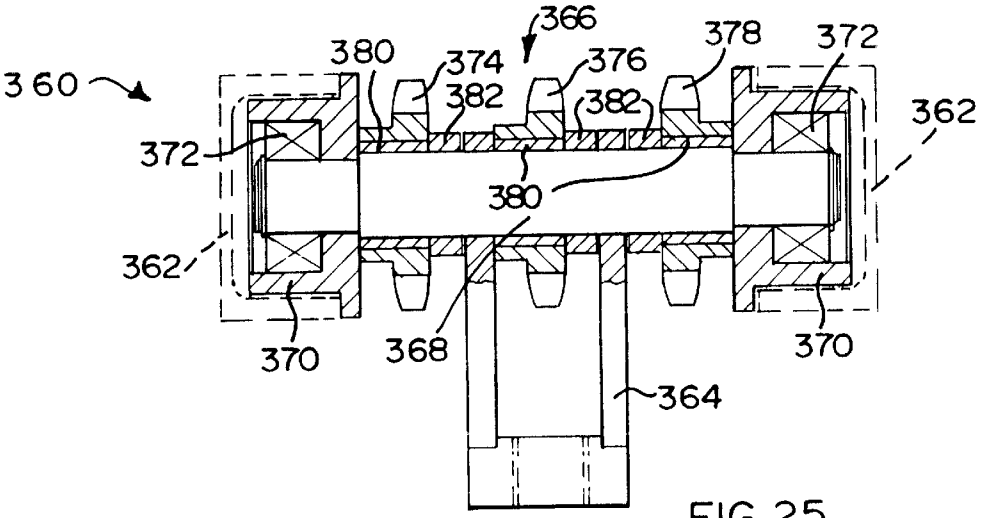
FIG. 25 shows, on an enlarged scale, a sectional elevation taken at XXV—XXV in FIG. 24.

Reference is now made to FIGS. 24 and 25 of the drawings, which show another embodiment of a hydraulically operated first displacement means in accordance with the invention. Unless otherwise indicated, the same reference numerals used above are used to designate similar parts. In this embodiment of the invention, the first displacement means 52 includes a plurality of parallel longitudinally spaced apart transversely extending guides, generally indicated by reference numeral 360. Each guide 360 includes a pair of parallel spaced apart inwardly facing channel members 362 which are mounted on the base frame 202. Mounted on the base frame between each pair of channel members 362 is an hydraulic piston and cylinder assembly 364. A drive head, generally indicated by reference numeral 366 is mounted to a free end of the piston of the piston and cylinder assembly 364. As can best be seen in FIG. 25 of the drawings, the drive head 366 includes a shaft 368 which is mounted on the end of the piston 364. Rollers 370 are rotatably mounted via bearings 372 on the ends of the shaft 368. The rollers 370 are shaped, dimensioned and positioned such that they run in the channel members 362. Three toothed sprockets 374, 376, 378 are rotatably mounted on the shaft 368 via bushes 380. Three spacing rings 382 are mounted on the shaft 368 to maintain the sprockets 374, 376, 378 in the desired positions.

One end of an extension chain 384 is pivotally connected via a pivot pin 386 to the base frame 202. The extension chain extends around the central sprocket 376 and its other end is pivotally connected to the floor 12 by a connecting arrangement 388. The connecting arrangement 388 includes a channel shaped member 390 mounted to the underside of the floor 12 and a connecting pin 392 which extends through registering holes in the channel shaped member 390 and to which the end of the extension chain 384 is connected by a pivot pin 394. The end of the connecting pin 392 remote from the pivot pin 394 is screw-threaded and a pair of lock nuts 396 is mounted thereon. A coil spring 398 is mounted around the connecting pin 392 in compression between the lock nuts 396 and the channel shaped member 390. Hence, by adjusting the positions of the lock nuts 396 on the connecting pin 392 the tension applied to the extension chain 384 can be adjusted.

Similarly, a pair of retraction chains 400 (one of which is shown in FIG. 24) is connected to the base frame 202 and to the floor 12 in the manner described above, the retraction chains extending around the sprockets 374 and 378 so that, as can best be seen in FIG. 24 of the drawings, the extension chain 384 and the retraction chains 400 are oppositely disposed. The retraction chains 400 are connected to the base frame by means of a pivot pin 402 and to the floor 12 by means of a connecting arrangement 404 which is substantially identical to the connecting arrangement 388 described above and, unless otherwise indicated, similar components of the connecting arrangement 404 are indicated by the same reference numerals used in respect of the components of the connecting arrangement 388.

Figure 13:
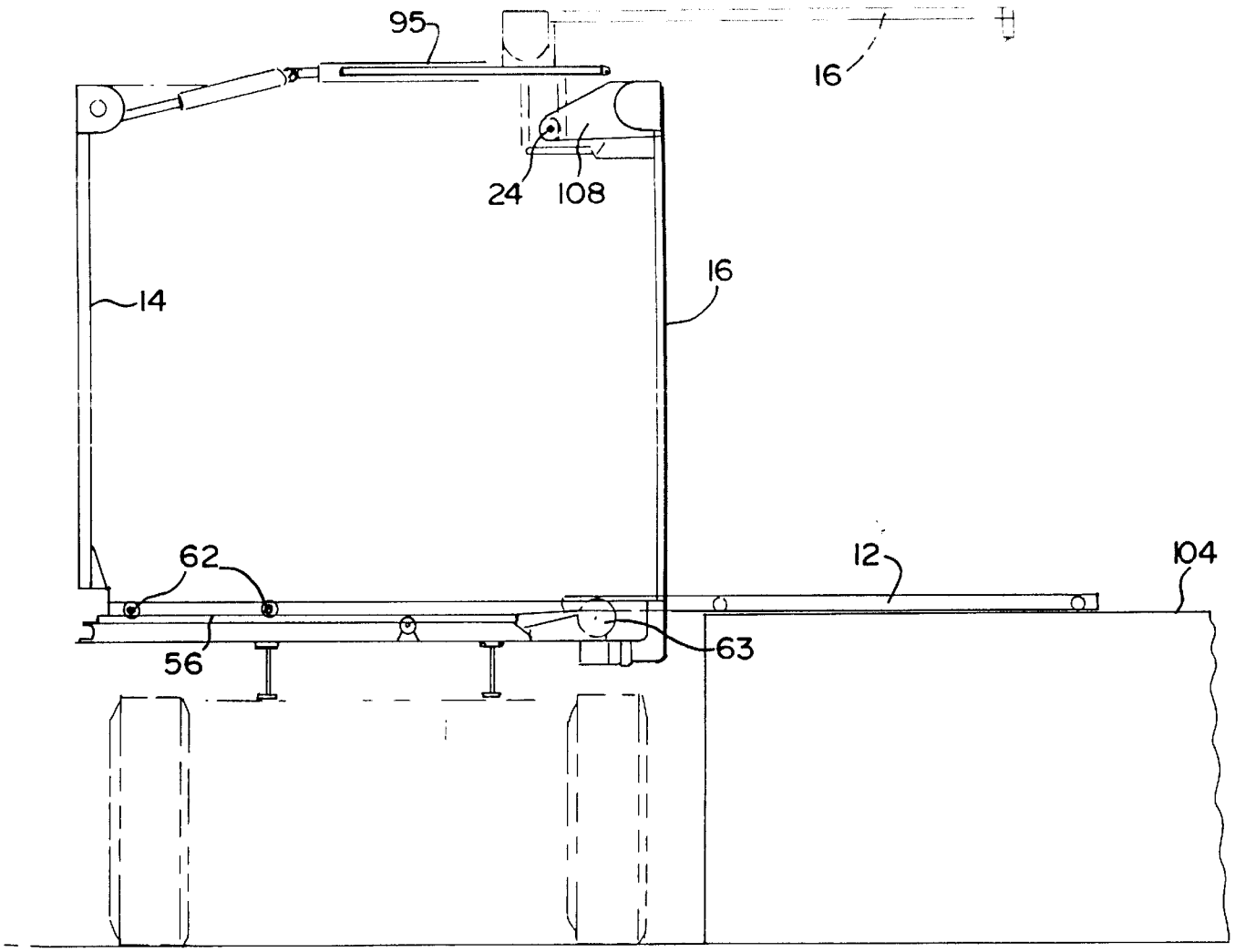
FIG. 13 shows an end view similar to FIG. 12 of another container in accordance with the invention with the floor and said one side wall being disconnected and with the floor and the other side wall shown in a displaced position.

In use, in order to displace the floor 12 from its rest position towards its displaced position, the piston and cylinder assemblies 364 are extended. This applies a tension to the extension chains 384 which causes the floor 12 to be displaced in the direction of arrow 406. Depending on whether or not the side wall 14 is hingedly connected to the floor 12 the floor will either be displaced horizontally, as shown in FIG. 13, or it will be tilted, as shown in FIG. 12, in the manner described above.

When it is desired to return the floor 12 to its rest position, the piston and cylinder assemblies 364 are retracted which results in a tension being applied to the retraction chains 400 which in turn results in the floor 12 being displaced in a direction opposite to the direction of arrow 406.

The Inventor believes that this arrangement has relatively few moving parts and as a result will be relatively cost effective to manufacture and that it will be reliable in use. In addition, the provision of the springs 398 serves both to maintain tension in the chains an d to reduce the transmission of shock.

Figure 18:
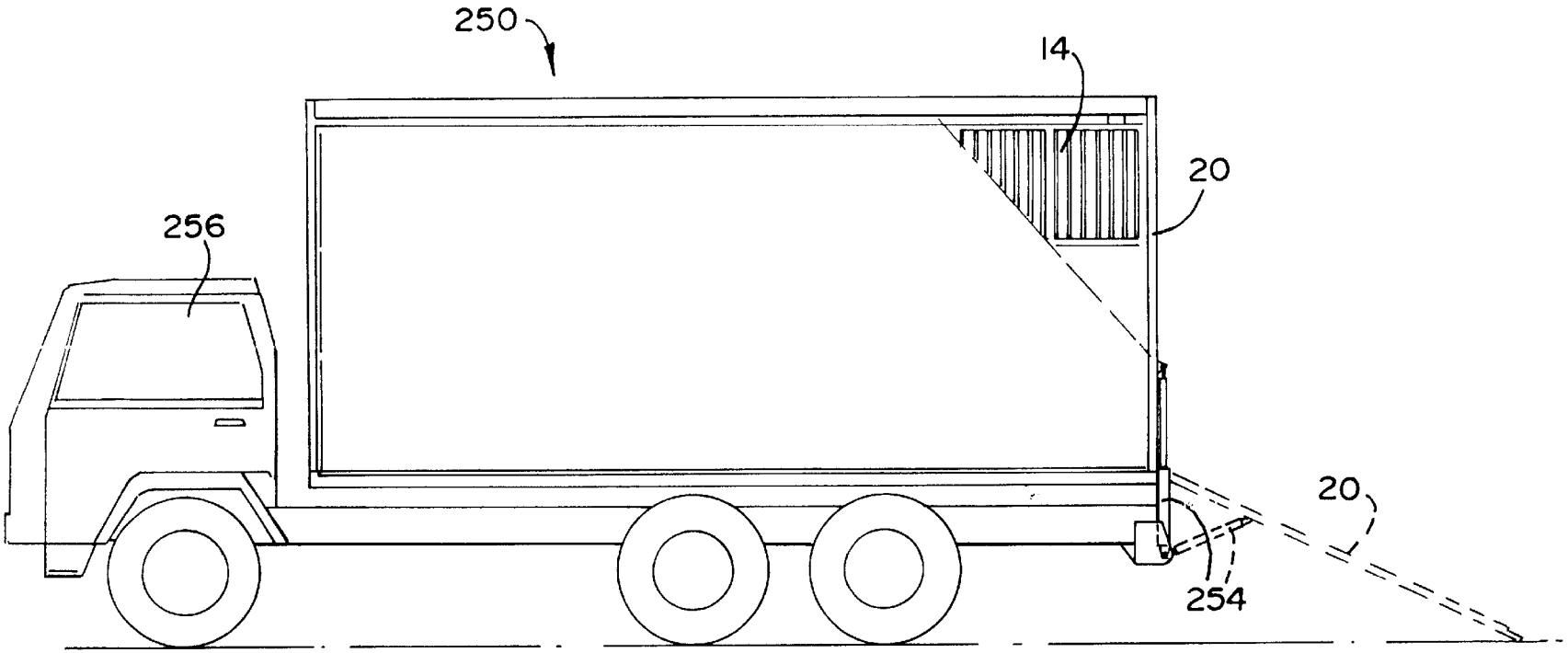
FIG. 18 shows a side view of another container in accordance with the invention mounted on a load carrying vehicle.
Figure 19:
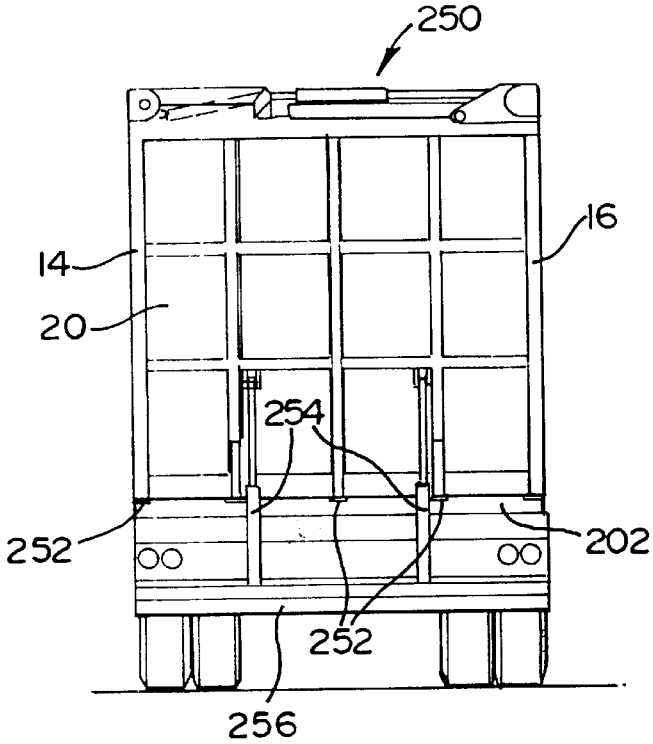
FIG. 19 shows a rear view of the container and vehicle of FIG. 18.

Refer ence is now made to FIGS. 18 and 19 of the drawings, in which reference numeral 250 refers generally to another container in accordance with the invention and, unless otherwise indicated, the same reference numerals used above are used to designate similar parts.

The main d ifference between the container 250 and the containers as described above is that the end wall 20 of the container 250 is displaceable between a closed position (shown in solid lines in FIG. 1 of the drawings) and an open position (shown in broken lines in FIG. 18 of the drawings).

As can best be seen in FIG. 19 of the drawings, the end wall 20 is hingedly connected via hinges 252 to the base frame 202. Displacement of the end wall 20 between its open and closed position is effected by means of a pair of hydraulic piston and cylinder assemblies 254 which are connected between the end wall 20 and a vehicle 256 on which the container is mounted.

The Inventor believes that the container 250 will have all the advantages of the container set out above and in addition, facilitates the loading and unloading of the container from an end thereof.

The Inventor believes that a container in accordance with the invention will be particularly versatile since it can be operated as a conventional side discharge container or alternatively by disconnecting the hinge mechanisms 26 the floor 12 can be displaced independently of the side wall 14 thereby facilitating the loading and off loading of other goods such as palletised goods.

In addition, the fact that the container is self contained permits it to be transported to a desired location at which it can be off loaded from the vehicle and supported on a suitably desired support. The container can then be loaded or unloaded making use of its own power source and permitting the vehicle on which it was transported to be used for other purposes.

In addition, a vehicle could deliver a load of particulate material to a desired location and instead of returning empty to its starting point it could be used to transport any other type of load on its return journey.

In addition, the Inventor believes that the particular construction of the container will permit it to be of very light construction thereby minimising its weight and maximising the payload which can be carried and thereby the efficiency with which goods are transported. More particularly, the Inventor believes that the particular arrangement of the rollers and tracks will provide support to the floor along its length as well as across its width. This permits the floor to be of relatively light construction even if it is relatively long. In this regard, the Inventor has found that a container having a floor of 9 m in length still works satisfactorily. In addition, the particular arrangement of the rollers and tracks serves to reduce the risk of twisting of the floor and jamming.

What is claimed is:

1. A container for use in the transportation of goods, which includes a floor;

a pair of opposed side walls, at lease one of which is supported for displacement about a pivotal axis adjacent its upper edge;

hinge means whereby said one side wall is disconnectably connectable adjacent its lower edge to the floor; and first displacement means for displacing the floor laterally between a rest position in which goods can be contained within the container, and a displaced position, the first displacement means being configured such that when the floor and said one side wall are hingedly connected together, and the floor is displaced from its rest position towards its displaced position, the floor will tilt downwardly outwardly thereby facilitating the discharge of flowable goods from the container and when the floor and said one side wall are disconnected, the floor is then displaced laterally in a level fashion that in its displaced position it protrudes from the container to facilitate the loading and unloading of goods.

2. A container as claimed in claim 1, in which the first displacement means includes a drive member positioned underneath the floor and at least one elongate flexible element drivingly connecting the drive member to the floor.

3. A container as claimed in claim 2, in which the elongate flexible element includes at least one chain.

4. A container as claimed in claim 2, in which the drive member is actuated by a pressurised fluid.

5. A container as claimed in claim 2, in which the drive member is electrically operated.

6. A container as claimed in claim 2, in which the drive member is mechanically operated.

7. A container as claimed in claim 1, which includes third displacement means for displacing said one side wall, when not connected to the floor, outwardly away from its rest position to an open position.

8. A container as claimed in claim 7, in which the third displacement means includes a pressurised fluid operated piston and cylinder arrangement configured to displace said one side wall between its open and closed positions.

9. A container as claimed in claim 1, which includes friction reducing floor support means for supporting the floor to facilitate displacement thereof between its rest and displaced positions.

10. A container as claimed in claim 9, in which the friction reducing floor support means includes a plurality of longitudinally spaced apart transversely extending tracks and longitudinally spaced apart sets of rollers which run on the tracks.

11. A container as claimed in claim 10, in which the rollers are connected to the underside of the floor and the tracks are fixed to a support.

12. A container as claimed in claim 10, in which each roller has an annular recess therein within which a portion of the associated track is receivable to locate the roller laterally relative to the track.

13. A container as claimed in claim 1, which includes second displacement means for displacing the other side wall between a closed position and an open position.

14. A container as claimed in claim 13, in which the second displacement means includes at least one elongate connecting member connected to and extending between the side walls such that the side walls are displaced simultaneously.

15. A container as claimed in claim 13, in which the second displacement means is configured to displace the other side wall independently of the floor and said one side wall.

16. A container as claimed in claim 13, in which the second displacement means includes a pressurised fluid operated piston and cylinder arrangement configured to displace the other side wall between its closed and open positions.

17. A container as in claim 1, which includes a pair of end walls at least one of which is displaceable between an open position and a closed position.

18. A container as claimed in claim 17, which includes fourth displacement means for displacing said one end wall between its open and closed positions.

19. A container as claimed in claim 18, in which said one end wall is hingedly mounted for pivotal displacement about a pivot axis adjacent its lower edge between its open and closed positions, the fourth displacement means including a pressurised fluid operated piston and cylinder assembly.

20. A container as claimed in claim 1, which includes locking means for retaining said one side wall releasably in its closed position.

21. A container as claimed in claim 1, which includes a power source for operating the displacement means so that the container is self contained and does not require an external power source to permit operation of the displacement means.

22. A container as claimed in claim 1, which is dismountably mountable on a load carrying vehicle and includes locking formations configured to cooperate with complementary locking formations on a said load carrying vehicle to retain the container releasably in position on a sad vehicle.

23. A load carrying vehicle which includes a chassis; and a container as claimed in claim 1 mounted on the chassis.

24. A container for use in the transportation of goods, which includes a body defining a goods receiving compartment;

an access opening through which access can be gained to the goods receiving compartment;

a closure member mounted for displacement between a closed position in which it closes off the access opening and an open position; and locking means for locking the closure member releasably in its closed position, the locking means including complementary locking components mounted on the body and on the closure member which complementary locking components cooperate when the door is in its closed position, and locking component displacement means configured to displace at least one of the locking components between an extended position in which the complementary locking components are releasably engageable and a retracted position such that displacement of said at least one of the locking components from its extended to its retracted position when the locking components are engaged serves to displace the closure member to its closed position.

25. A container as claimed in claim 24, in which the locking components are engageable and disengageable only when said at least one of the locking components is in its extended position.

26. A container as claimed in claim 24 which the locking component displacement means includes a rotatable eccentric element which cooperates with said at least one locking component.

* * * * *